US009850765B2

(12) United States Patent
Singer et al.

(10) Patent No.: US 9,850,765 B2
(45) Date of Patent: Dec. 26, 2017

(54) RHENIUM-FREE OR RHENIUM-REDUCED NICKEL-BASE SUPERALLOY

(71) Applicant: MTU Aero Engines AG, Munich (DE)

(72) Inventors: Robert F. Singer, Erlangen (DE); Ernst Affeldt, Groebenzell (DE); Michael Weiss, Dachau (DE); Thomas Goehler, Munich (DE); Ralf Rettig, Erlangen (DE)

(73) Assignee: MTU Aero Engines AG, Munich (DE)

( * ) Notice: Subject to any disclaimer, the term of this patent is extended or adjusted under 35 U.S.C. 154(b) by 658 days.

(21) Appl. No.: 14/363,749

(22) PCT Filed: Oct. 17, 2012

(86) PCT No.: PCT/DE2012/001009
§ 371 (c)(1),
(2) Date: Jun. 6, 2014

(87) PCT Pub. No.: WO2013/083101
PCT Pub. Date: Jun. 13, 2013

(65) Prior Publication Data

US 2014/0356183 A1 Dec. 4, 2014

(30) Foreign Application Priority Data

Dec. 7, 2011 (DE) ..... 10 2011 120 388

(51) Int. Cl.
*F01D 5/28* (2006.01)
*C22C 19/05* (2006.01)

(52) U.S. Cl.
CPC ..... *F01D 5/28* (2013.01); *C22C 19/057* (2013.01); *F05D 2300/173* (2013.01); *F05D 2300/174* (2013.01); *F05D 2300/175* (2013.01); *F05D 2300/177* (2013.01)

(58) Field of Classification Search
CPC ..... F01D 5/28
See application file for complete search history.

(56) References Cited

U.S. PATENT DOCUMENTS

| | | | | |
|---|---|---|---|---|
| 6,054,096 | A * | 4/2000 | Duhl | C22C 19/057 420/442 |
| 6,177,046 | B1 * | 1/2001 | Simkovich | C22C 19/03 148/427 |
| 6,546,713 | B1 * | 4/2003 | Hidaka | C22C 19/055 60/39.182 |
| 9,108,266 | B2 * | 8/2015 | Cui | B23K 15/0073 |
| 2009/0185944 | A1 * | 7/2009 | Hu | C22C 19/057 420/448 |
| 2010/0254822 | A1 * | 10/2010 | Hazel | C22C 19/057 416/241 R |
| 2012/0267344 | A1 * | 10/2012 | Cui | B23K 15/0073 219/121.14 |

FOREIGN PATENT DOCUMENTS

| | | | |
|---|---|---|---|
| EP | 0 150 917 | A2 | 8/1985 |
| EP | 2 218 798 | A2 | 8/2010 |
| EP | 2 305 848 | A1 | 4/2011 |
| EP | 2 333 121 | A1 | 6/2011 |
| JP | 2011046972 | A * | 3/2011 |
| WO | WO 2009/032578 | A1 | 3/2009 |
| WO | WO 2009/032579 | A1 | 3/2009 |

OTHER PUBLICATIONS

Machine generated translation of JP2011046972 generated Apr. 7, 2017 via eSpace.*
STIC 1700; Search Report for U.S. Appl. No. 14/363,749; Generated Aug. 8, 2017.*
PCT/DE2012/001009 International Search Report dated Jan. 31, 2013 (Two (2) pages).

* cited by examiner

*Primary Examiner* — Gregory Anderson
*Assistant Examiner* — Eldon Brockman
(74) *Attorney, Agent, or Firm* — Crowell & Moring LLP

(57) ABSTRACT

A nickel-base superalloy is disclosed. The superally includes aluminum, cobalt, chromium, molybdenum, tantalum, titanium and tungsten, in addition to nickel, as alloy constituents, wherein rhenium can additionally be contained and the rhenium content is less than or equal to 2 wt. % and wherein the titanium content is greater than or equal to 1.5 wt. %. Further disclosed is a component made of the nickel-base superalloy.

5 Claims, No Drawings

RHENIUM-FREE OR RHENIUM-REDUCED NICKEL-BASE SUPERALLOY

This application claims the priority of International Application No. PCT/DE2012/001009, filed Oct. 17, 2012, and German Patent Document No. 10 2011 120 388.9, filed Dec. 7, 2011, the disclosures of which are expressly incorporated by reference herein.

BACKGROUND OF THE INVENTION

Field of the Invention

The present invention relates to a nickel-base superalloy with little or no rhenium content.

Prior Art

Hard use conditions prevail in gas turbines such as stationary gas turbines for power generation or aircraft engines for the material used because these materials are exposed to high mechanical loads and high temperatures at the same time, in particular for the rotor blades, so that in addition to a high strength, a sufficiently high phase stability as well as creep resistance and oxidation resistance of the material are required.

To do justice to these requirements, nickel-base superalloys, for example, are used, optionally as single-crystal alloys or as directionally solidified alloys. These alloys have a high strength due to their alloy constituents because of the mixed crystal hardening and/or precipitation hardening or particle hardening. In addition, such nickel-base superalloys are optimized, so that the particle hardening is preserved due to the mixed crystal hardening and/or precipitation hardening or particle hardening due to their alloy constituents. In addition, such nickel-base superalloys have been optimized to the extent that the particle hardening is preserved due to the precipitation of so-called y' phases, even at high temperatures and with long use times.

Examples of such alloys include nickel-base superalloys such as CMSX-4, PWA-1484 or Rene N5. All of these alloys have a rhenium content of more than 3% by weight.

However, the cost of materials is very high due to the high rhenium content, so there have already been proposals for developing nickel-base superalloys having little or no rhenium content. Examples of this are described in EP 2 305 848 A1, EP 2 218 798 A2, WO 2009/032578 and WO 2009/032579.

DISCLOSURE OF THE INVENTION

Object of the Invention

Although nickel-base superalloys with little or no rhenium content have already been described in the prior art, there is still a demand for rhenium-free and/or rhenium-reduced nickel-base superalloys in which the profile of properties is further optimized. There is a demand in particular for supplying an alloy, which has a high content (by volume) of precipitates, even at high temperatures, in order to have the necessary strength and in particular creep strength, even at high use temperatures.

Technical Approach

This object is achieved by a nickel-base superalloy. Advantageous embodiments are the subject matter of the dependent claims.

According to the present invention, it is proposed that the titanium content be adjusted to be greater than or equal to 1.5% by weight, in particular greater than or equal to 2% by weight in a nickel-base superalloy comprising aluminum, cobalt, chromium, molybdenum, tantalum, titanium and tungsten, in addition to nickel, as alloy constituents, with a rhenium content less than or equal to 2% by weight. It has surprisingly been found that it is possible with such a measure to reduce the rhenium content without having a negative effect on the strength and high temperature properties. The titanium content may be selected to be in the range of 1.5% to 3% by weight in particular.

In addition, in the absence of rhenium, the molybdenum content may be greater than 3% by weight.

Furthermore, the tungsten content and/or the tantalum content may be less than or equal to 8% by weight.

The tungsten content may be less than or equal to 5% by weight in particular. In the absence of molybdenum and/or with a low titanium content of 1.5% to 3% by weight, the tungsten content may also be selected to be in the range of 6% to 8% by weight.

The tantalum content may be less than or equal to 7.5% by weight in particular, preferably less than or equal to 5% by weight. In the absence of molybdenum and/or with a low titanium content of 1.5% to 3% by weight, the tantalum content may also be selected to be in the range of 6% to 8% by weight.

A nickel-base superalloy may thus have an aluminum content of 4% to 6% by weight, a cobalt content of 8% to 10% by weight, a chromium content of 5% to 8% by weight, a molybdenum content of 0% to 5.5% by weight, a tantalum content of 4% to 8% by weight, a rhenium content of 0% to 2% by weight, a titanium content of 1.5% to 5.5% by weight and a tungsten content of 3.5% to 8% by weight, with the remainder again nickel and unavoidable impurities.

Furthermore, a nickel-base superalloy may have an aluminum content of 4% to 6% by weight, a cobalt content of 8% to 10% by weight, a chromium content of 5% to 8% by weight, a molybdenum content of 2% to 5.5% by weight, a tantalum content of 4% to 6% by weight, a rhenium content of 0% to 1.5% by weight, a titanium content of 3% to 5.5% by weight and a tungsten content of 3.5% to 6% by weight, with the remainder being nickel and unavoidable impurities.

According to another embodiment, the nickel-base superalloy may have an aluminum content of 4.5% to 5.5% by weight, a cobalt content of 8.5% to 9.5% by weight, a chromium content of 6% to 7.5% by weight, a molybdenum content of 2% to 4% by weight, a tantalum content of 4% to 5.5% by weight, a rhenium content of 0.1% to 1% by weight, a titanium content of 3.5% to 5.5% by weight and a tungsten content of 4% to 5.5% by weight, with the remainder again being nickel and unavoidable impurities.

According to another embodiment, the nickel-base superalloy may have an aluminum content of 4.5% to 5.5% by weight, a cobalt content of 8.5% to 9.5% by weight, a chromium content of 6% to 7.5% by weight, a tantalum content of 6% to 8% by weight, a rhenium content of 0% to 2% by weight, a titanium content of 1.5% to 3% by weight and a tungsten content of 6% to 8% by weight, with the remainder again being nickel and unavoidable impurities.

Such alloys may be used in various forms, for example, as a directionally solidified alloy or as single components in gas turbines and in particular in aircraft engines. The alloys may be used in particular for turbine blades and in particular rotor blades of low-pressure turbines.

Exemplary Embodiments

The present invention may be implemented in particular by alloys having the following compositions:

| Abbreviation | Elementary content (wt %), remainder nickel | | | | | | | |
|---|---|---|---|---|---|---|---|---|
| | Al | Co | Cr | Mo | Re | Ta | Ti | W |
| Alloy 1 | 5 | 9 | 7 | 2.5 | 1 | 5 | 4.25 | 4.5 |
| Alloy 2 | 5 | 9 | 6.5 | 3.5 | 1 | 5 | 3.75 | 4.5 |
| Alloy 3 | 5 | 9 | 6.5 | 3.5 | 0 | 4.5 | 4.5 | 5 |
| Alloy 4 | 5 | 9 | 6.5 | 0 | 2 | 6 | 1.5 | 8 |
| Alloy 5 | 5 | 9 | 6.5 | 0 | 1.5 | 7 | 2 | 7 |
| Alloy 6 | 5 | 9 | 6.5 | 0 | 1 | 8 | 3 | 6 |

Such alloys achieve a high precipitation content even at high temperatures, i.e., at temperatures in the use range of the low-pressure turbines of an aircraft engine, so that the strength and in particular the creep strength are elevated. At the same time, there is also a high precipitation content even at low temperatures, so that corresponding strength values are also achieved there.

With the alloys presented here, it is possible in particular to improve the distribution ratios of tungsten and molybdenum between precipitations and the matrix phase, which makes it possible to reduce the rhenium content. But this not only reduces the cost of materials but also reduces the density of the alloy, which is of crucial importance for components in aircraft engine design, because the weight of the aircraft engine can be reduced and its efficiency can be increased.

Alloys 4 through 6 have better casting and/or heat treatment properties in comparison with the alloys 1 to 3.

Although the present invention has been described on the basis of the exemplary embodiments, it will be clear for those skilled in the art that the invention is not limited to these embodiments but instead is limited only by the scope of protection of the accompanying claims.

The invention claimed is:

1. A nickel-base superalloy comprising aluminum in an amount of 4% to 6% by weight, cobalt in an amount of 8% to 10% by weight, chromium in an amount of 5% to 8% by weight, molybdenum in an amount of 2% to 5.5% by weight, tantalum in an amount of 4% to 8% by weight, rhenium in an amount of 0% to 2% by weight, titanium in an amount of 1.5% to 5.5% by weight, and tungsten in an amount of 3.5% to 8% by weight, as well as a remainder of nickel and unavoidable impurities.

2. A nickel-base superalloy comprising aluminum in an amount of 4.5% to 5.5% by weight, cobalt in an amount of 8.5% to 9.5% by weight, chromium in an amount of 6% to 7.5% by weight, tantalum in an amount of 6% to 8% by weight, rhenium in an amount of less than 2% by weight, titanium in an amount of greater than 1.5% by weight, and tungsten in an amount of 6% to 8% by weight as well as a remainder of nickel and unavoidable impurities.

3. A component of a gas turbine comprised of a superalloy according to claim 1.

4. The component according to claim 3, wherein the component is an aircraft engine.

5. The component according to claim 3, wherein the component is a turbine blade of a low-pressure turbine.

* * * * *